US005232203A

United States Patent [19]

Butts

[11] Patent Number: 5,232,203

[45] Date of Patent: Aug. 3, 1993

[54] JACK FOR LIGHT AIRCRAFT

[76] Inventor: Bobbie C. Butts, 1548 SE. 11th St., Gresham, Oreg. 97080

[21] Appl. No.: 919,957

[22] Filed: Jul. 27, 1992

[51] Int. Cl.[5] ..... B66F 3/00

[52] U.S. Cl. ..... 254/8 R; 254/94; 254/131; 254/134

[58] Field of Search ..... 254/94, 422, 131, 133, 254/134, 8 R, 8 B

[56] References Cited

U.S. PATENT DOCUMENTS

| | | | |
|---|---|---|---|
| 601,771 | 3/1926 | Zimmermann | 254/94 |
| 1,460,229 | 6/1923 | Deal | 254/94 |
| 1,666,971 | 4/1928 | McCarty | 254/94 |
| 2,903,258 | 9/1959 | Jovanovich | 254/134 |
| 3,036,817 | 5/1962 | Morici | 254/134 |
| 3,512,755 | 5/1970 | Donakowski | 254/131 |
| 3,809,261 | 5/1974 | Lee | 254/131 |
| 3,902,699 | 9/1975 | Brackett | 254/134 |
| 4,113,235 | 9/1978 | Hartman | 254/131 |
| 4,180,253 | 12/1979 | Ivers et al. | 254/131 |
| 4,193,582 | 3/1980 | Neilsen . | |
| 4,218,043 | 8/1980 | LeVert | 254/134 |

*Primary Examiner*—Robert C. Watson
*Attorney, Agent, or Firm*—James D. Givnan, Jr.

[57] ABSTRACT

A base is wheel supported and carries an upright post member having laterally spaced apart brackets for engagement with two blades of a two or three bladed propeller when lifting a nose wheel. Each bracket is provided with a liner to avoid marring of blade edges. Post members of different lengths are provided for use in lifting a main gear wheel of low wing and high wing aircraft. Both of the last mentioned post members pivotally carries a lift pad for engagement with a wing surface. A method is disclosed for lifting a nose or main gear wheel off the ground to a stable elevated position. Fastener assemblies lock the propeller engaging brackets in the upright or inclined positions to engage a two bladed or a three bladed propeller.

7 Claims, 1 Drawing Sheet

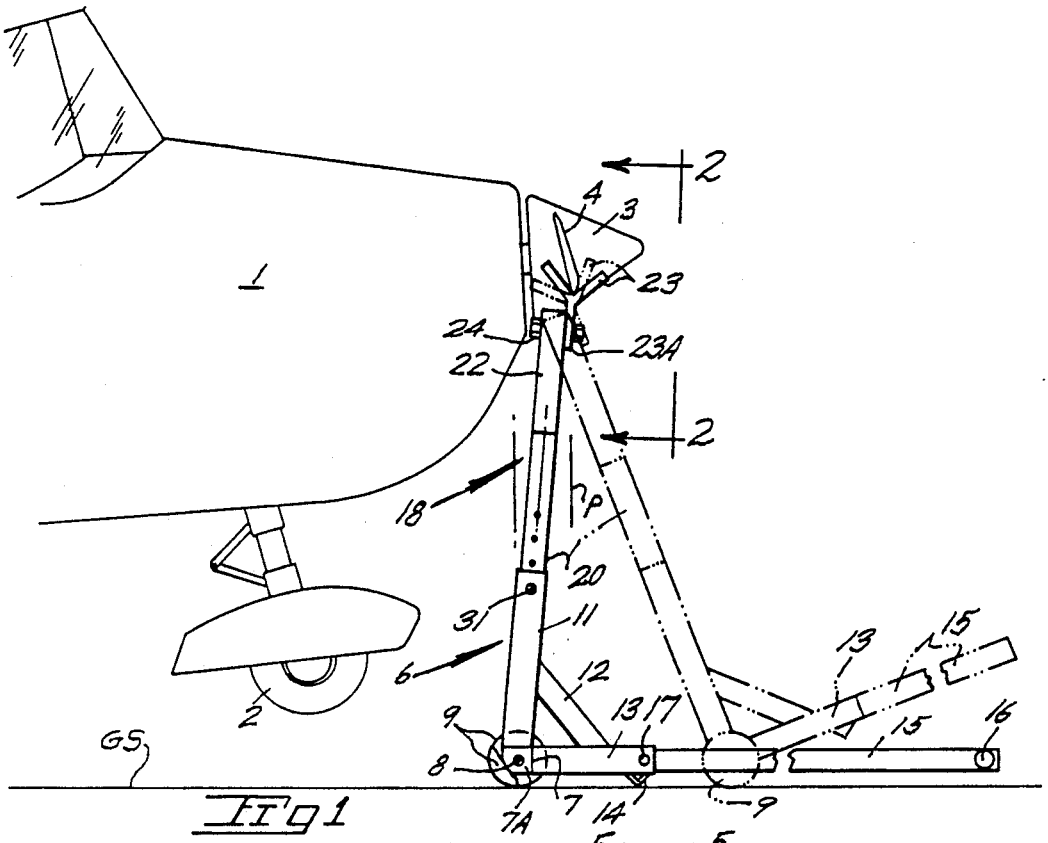
Fig 1
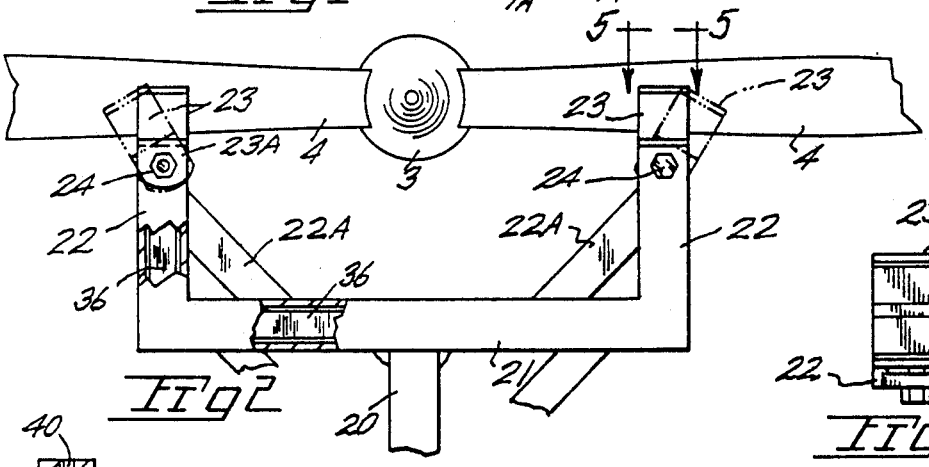
Fig 2
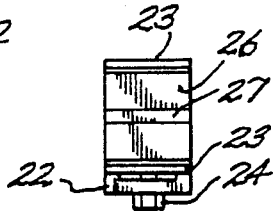
Fig 5
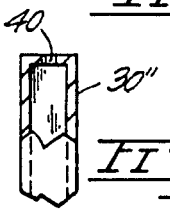
Fig 6
Fig 3
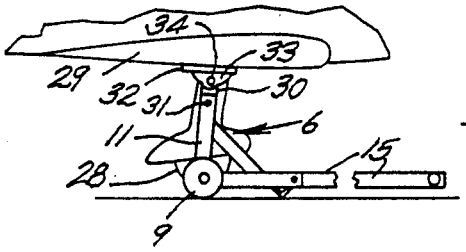
Fig 4
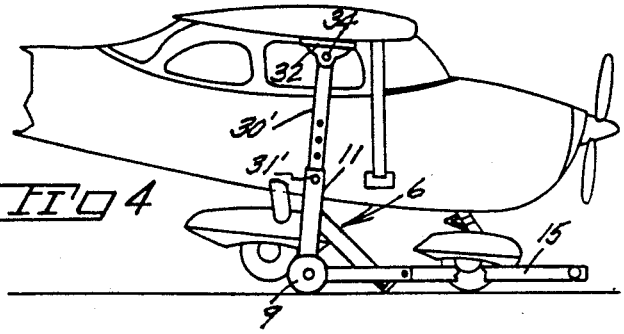

JACK FOR LIGHT AIRCRAFT

BACKGROUND OF THE INVENTION

The present invention pertains generally to jacks and particularly aircraft jacks for lifting of an aircraft wheel for servicing, changing, etc.,.

Front and main wheel assemblies of light aircraft equipped with tricycle landing gear must be periodically lifted for inspection and servicing purposes. While heavy duty hydraulic jacks can be used for such a purpose, it is highly inconvenient to move such a jack to an aircraft parked in an area remote from a shop or hangar where the hydraulic jack is stored. Such jacks are heavy and primarily for use on concrete or other paved surfaces. Further, hydraulic jacks require great care in their use as considerable lifting forces may be applied to the aircraft and care is required to assure such forces are properly applied only to an appropriate surface area of the aircraft.

U.S. Pat. No. 4,193,582 is of interest in that it discloses a jack for lifting motorcycles which has an over center, elevated position where a handle engages a ground surface to limit handle travel.

SUMMARY OF THE PRESENT INVENTION

The present invention is embodied in an manually operated jack wherein lifting forces are imparted to the aircraft by physical effort applied to a lever of the jack.

The present jack includes provision for imparting lifting forces to the propeller of a light aircraft for raising a nose gear wheel off the ground. Alternatively, the lifting of a main gear wheel off the ground may be accomplished to permit inspection, changing, servicing, etc., of same. The present jack is of lightweight reinforced construction permitting convenient use and transport to the point of use.

A post assembly is preferably of segmented construction to permit adapting of the jack to different lifting tasks i.e., nose gear or a main gear of a wide range of different sizes of light aircraft. Further, low wing and high wing aircraft may be serviced with the jack with but a substitution of a post assembly component. Brackets are provided on the post assembly to engage two and three bladed propellers without marring of propeller surfaces. A resilient pad on a post assembly component distributes loading on the aircraft surface and protects same from damage.

Important objectives include the provision of a jack which imparts a lifting force to an aircraft to an over center position of jack whereat the jack is prevented from being moved and the aircraft lowered until a lifting force is again applied to a lever of the jack; the provision of a jack for lifting a light aircraft having two or three bladed propellers with only simple adjustment of jack lift brackets being required; the provision of a method for lifting the nose gear about the axis of the main gear or one of the main gear off the ground and locking same in an elevated position by moving of the jack post assembly to an over center position from which lowering of the jack can only be achieved by again lifting of the jack supported portion of the aircraft while the post assembly is relocated back through and beyond the center of gravity of the load supported; the provision of a jack having tubular components reinforced by internal stiffeners; the the provision of a jack for light aircraft for lifting engagement with the edges of propeller blades.

BRIEF DESCRIPTION OF THE DRAWINGS

In the drawings:

FIG. 1 is a side elevational view of the present jack in place supporting the front end of a tricycle gear equipped aircraft;

FIG. 2 is an elevational view taken along line 2—2 of FIG. 1;

FIG. 3 is a side elevational view of the jack with a post assembly modified to lift a wing of a low wing tricycle gear equipped aircraft;

FIG. 4 is a side elevational view of the jack with a post assembly modified to lift a wing of a high wing tricycle gear equipped aircraft;

FIG. 5 is a plan view of a bracket taken downwardly along line 5—5 of FIG. 2; and FIG. 6 is an elevational view of a fragment of a modified post member having an aperture at its upper end.

DETAILED DESCRIPTION OF THE PREFERRED EMBODIMENTS

With continuing attention to the drawings, the reference numeral 1 indicates the forward fuselage of a single engine, light aircraft equipped with a nose gear having a nose wheel 2. A hub or spinner 3 carries a propeller with blades 4. A ground surface is at GS.

The present jack includes a base generally at 6 having a horizontal cross member 7 provided with end plates 7A apertured to receive an axle 8 for wheels 9. Centrally disposed on cross member 7 is an upright elongate member 11 of tubular construction additionally supported by a brace 12 which terminates in securement to a rearwardly extending tubular member 13 having a ground surface engageable foot 14. Tubular member 11 is somewhat inclined, 5 degrees or so, off the vertical when member 13 is supported by ground surface GS. Base members 11 and 13 define an included angle of somewhat less than ninety degrees.

A handle at 15 extends in telescopic fashion rearwardly from tubular member 13 and is equipped with hand grips as at 16. A pin 17 joins the handle in inserted engagement with member 13. Handle 15 is of approximately five feet in length.

A post assembly, generally at 18, includes an upright main post member 20 for inserted engagement with the jack base and includes a cross arm 21 having an upright tubular end member 22 at each of its ends and braced at 22A. Each end member carries a bracket 23 of forked shape in side elevation and has a downwardly extending plate 23A of the bracket attached to the upper end of the tubular end member by a fastener assembly 24. Each bracket 23 is positionable about the axis of its respective fastener assembly to incline the bite or forked portion of the bracket to receive a blade of a three bladed propeller. For lifting of a nose gear of an aircraft, the brackets project upwardly from their supporting end member (FIG. 2) in staggered fashion i.e., one bracket attached forwardly and the remaining bracket attached rearwardly, with the leading edge of one propeller blade cradled in one bracket and the trailing edge of a remaining blade cradled in the remaining bracket. The inner, convergent surfaces of each bracket are provided with a liner 26 of non-metallic material having a low coefficient of friction such as the material sold under the registered trademark Teflon to prevent marring of the blade edge. A strip 27 of soft rubber at the lower portion of the convergent surfaces of the brackets prevents linear slippage of the blade edge in the bracket.

In FIGS. 3 and 4 portions of low and high wing aircraft are shown with a single main gear wheel lifted for the purpose at hand. For lifting of a main gear wheel 28 carried by a low wing 29, a modified post assembly includes a post member 30 of reduced length carried by base 6. The post member 30 is equipped with a lift plate 32 equipped with a pin receiving clevis 33. A locking pin 31 passes through base member 11 and through the inserted portion of post member 30. In FIG. 4 a post member 30' is of greater length and has a series of lengthwise spaced apertures which selectively receive a locking pin 31' passing through the selected apertures in base member 11 and the post member. A lift plate 32 is pivotally attached to the upper n end of the post member 30' by a fastener assembly 34 and preferably includes a resilient pad thereon to cushion the abutment with the aircraft wing of a high wing, light aircraft. As some aircraft have jack receiving studs projecting from the lower surface of their wings, a still further modified post member at 30'' in FIG. 6 is provided with a socket 40 in the post upper end to receive such a stud.

The tubular material forming the cross arm 21 and upright end members 22 may be internally reinforced by blocks 36 of solid nonmetallic material.

In use of the jack, the same may be utilized for the lifting of a nose wheel as well as either main gear wheels of tricycle landing gear equipped aircraft. Additionally, the jack may be used for the lifting of a main gear wheel of an aircraft equipped with conventional landing gear i.e., the landing gear includes a tail wheel.

In the lifting of a nose wheel, the jack is provided with the post assembly 18 with the brackets 23 set to the solid line position of FIG. 2 or the broken line position of FIG. 2 if the aircraft has a three bladed propeller. The brackets are then each engaged with an edge of each blade 4 whereafter a lifting force is imparted to the propeller blades by advancing the jack from the broken line position of FIG. 1 to the full line position. During such advancement the wheel supported base 6 rotates downwardly to carry the post assembly toward and through to one side of a vertical plane at P containing the upper end of said post assembly and the brackets thereon. Movement of base 6 beyond vertical plane P is limited by foot 14 on the base coming into contact with ground surface GS at a point oppositely offset from the vertical plane to position base 6 to maintain post assembly 18 in the slightly inclined position as shown in full lines in FIG. 1. Lowering of the nose wheel 2 about the aligned axes of the main gear wheels is accomplished by a pulling force exerted on handle 15 in a controlled manner. The main gear wheels are prevented from travel during this use of the jack.

The method of lifting a main gear wheel with the present jack is essentially the same as above described with the exception that the post assembly upper end is equipped with a lift plate 32 for engagement with the underside of the aircraft wing. During lifting and lowering of the main gear wheel, post member 30 will pivot about lift plate attachment fastener assembly 34.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A jack for lifting of a main landing gear wheel of an aircraft of the fixed wing type from a ground surface, said jack comprising, a base having a cross member, an elongate upright member and a laterally extending member on said cross member and having ground engaging means, wheels supporting said base and having a horizontal axis, a handle carried by said laterally extending member and extending outwardly therefrom, and a post assembly carried by said elongate upright member of the base and including a post member, a lift plate on the upper end of said post member, a pivot pin pivotally attaching said plate to said post member, said plate engageable with a wing of the aircraft, said post member initially inclined during a lifting operation in one direction from a vertical plane, lifting of the main landing gear wheel accomplished by movement of the base along the ground surface to move the post member toward and substantially through said vertical plane to locate said landing gear wheel and said ground engaging means oppositely from said vertical plane.

2. The jack claimed in claim 1 wherein said ground engaging means is a foot on said laterally extending member of the base.

3. The jack claimed in claim 1 wherein said pin coupling the lift plate to the uppermost end of said post member permits arcuate movement of the post member relative to the lift plate during jack use.

4. A jack for lifting of a landing gear of an aircraft from a ground surface, said jack comprising, a base having a cross member, an elongate upright member and a laterally extending member on said cross member and having ground engaging means, wheels supporting said base and having a horizontal axis, a handle carried by said laterally extending member and extending outwardly therefrom, and a post assembly carried by said elongate upright member of the base and including a post member having upright end members, aircraft engageable means on said post member and including brackets each having inclined surfaces for retentive engagement with a propeller blade of the aircraft, fastener assemblies each attaching one of said brackets to one of said upright end members in a manner permitting arcuate adjustment of said brackets about their espective fastener assemblies to permit use of the jack with aircraft having two bladed propellers and aircraft with three bladed propellers, said post member initially inclined during a lifting operation in one direction from a vertical plane, lifting of the landing gear accomplished by movement of the base along the ground surface to move the post member toward and substantially through said vertical plane to locate said wheels and said ground engaging means oppositely from said vertical plane.

5. The jack claimed in claim 4 wherein said ground engaging means is a foot on said laterally extending member of the base.

6. The jack claimed in claim 4, wherein said brackets including nonmetallic liners to isolate the propeller blades from contact with remaining portions of said brackets.

7. The jack claimed in claim 1 wherein said fastener assemblies permit arcuate positioning of the brackets for purposes of linear engagement of the brackets with the leading and trailing edges of both horizontally and inclined propeller blades.

* * * * *